US006050464A

United States Patent [19]

Ramsey, Sr. et al.

[11] Patent Number: 6,050,464

[45] Date of Patent: Apr. 18, 2000

[54] AUTOMATIC PISTOL LOADING SYSTEM

[76] Inventors: Phillip M. Ramsey, Sr., 1624 Briggs Chaney Rd., Silver Spring, Md. 20905; Stephen B. MacDonald, 424 Brock Bridge Rd., Laurel, Md. 20724

[21] Appl. No.: 09/061,907

[22] Filed: Apr. 17, 1998

Related U.S. Application Data

[60] Provisional application No. 60/044,469, Apr. 18, 1997.

[51] Int. Cl.[7] ..... A45F 5/00

[52] U.S. Cl. ..... 224/196; 224/197; 224/239; 224/240; 224/931; 206/3; 42/90

[58] Field of Search ..... 224/182, 196, 224/197, 199, 239, 240, 587, 931; 206/3, 384; 42/90

[56] References Cited

U.S. PATENT DOCUMENTS

| | | | |
|---|---|---|---|
| Re. 10,120 | 5/1882 | Chillingworth | 224/199 |
| 184,822 | 11/1876 | Bergman et al. | 224/199 |
| 243,144 | 6/1881 | Mac Connell | 224/199 |
| 1,301,377 | 7/1919 | Sisson | 224/931 |
| 1,344,377 | 6/1920 | Brothers | 224/199 |
| 2,837,259 | 6/1958 | Blanchard | 224/199 |
| 2,999,621 | 9/1961 | Kiser | 224/199 |
| 3,938,717 | 2/1976 | Theodore | 206/350 |
| 4,138,044 | 2/1979 | Musgrave . | |
| 5,152,442 | 10/1992 | Gallagher | 224/239 |
| 5,174,482 | 12/1992 | Rogers et al. | 224/239 |
| 5,303,860 | 4/1994 | Serafini, Jr. | 224/238 |
| 5,395,023 | 3/1995 | Naymark et al. | 224/253 |

FOREIGN PATENT DOCUMENTS

| | | | |
|---|---|---|---|
| 71499 | 10/1915 | Austria | 224/199 |

*Primary Examiner*—Stephen M. Johnson
*Attorney, Agent, or Firm*—Donald A. Kettlestrings

[57] ABSTRACT

A system for enabling one-handed loading of an ammunition magazine into an automatic pistol includes a flat support having a stop member at one end and a cover positioned over a portion of the support for attaching the support to a user's belt. A spring-loaded hinge biased toward an open position is connected to the support adjacent to the stop member for limiting movement of the hinge. A magazine holder is removably connected to the hinge for removably receiving and holding an ammunition magazine for an automatic pistol. A cover strap is attached to the cover for facilitating convenient carrying of the ammunition magazine when the cover strap is fastened in place. Release of the cover strap causes movement of the hinge by the spring to position the magazine in a position for facilitating one-handed loading of the magazine into an automatic pistol by the user. The magazine holder can be connected to the hinge for facilitating use by a right-handed or left-handed user.

19 Claims, 4 Drawing Sheets

Fig. 7
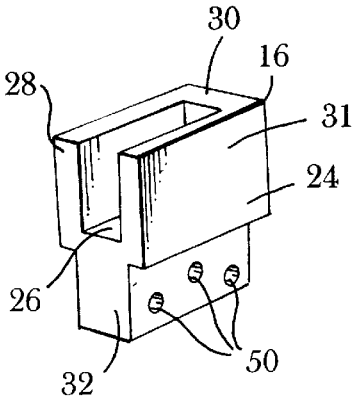
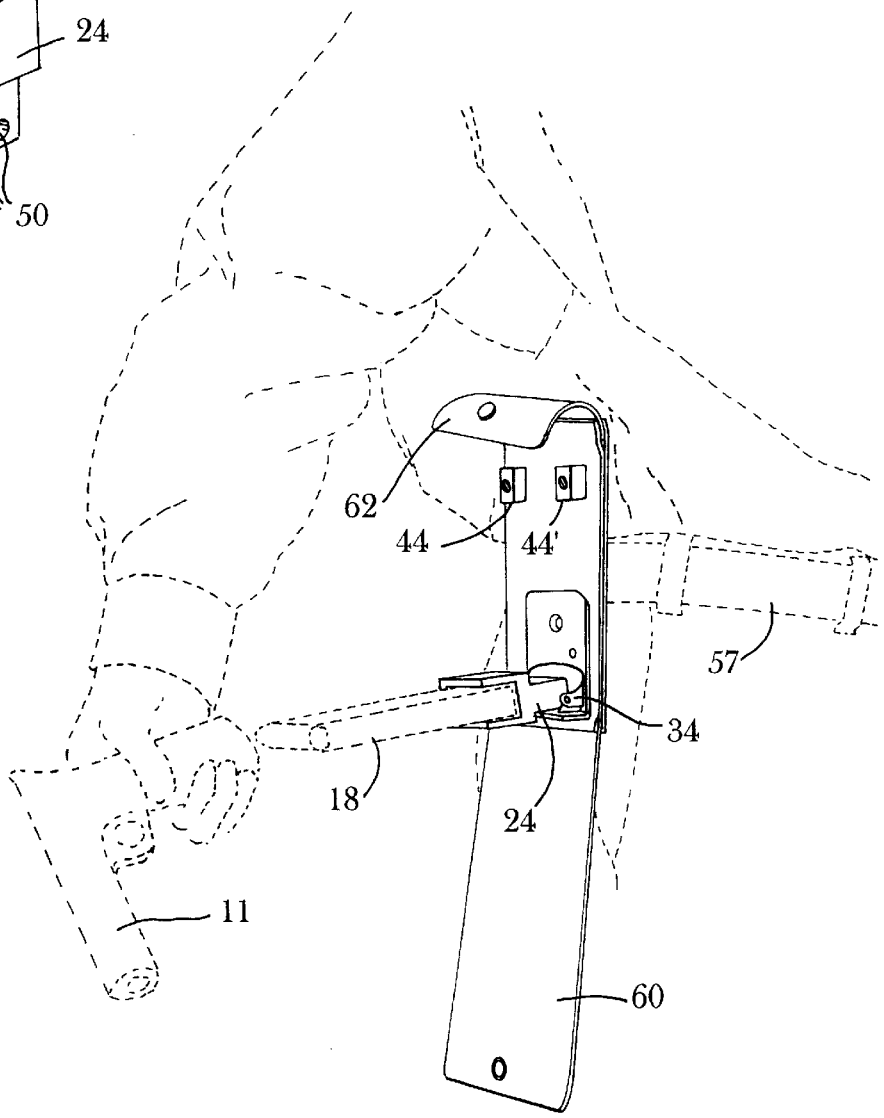
Fig. 6

AUTOMATIC PISTOL LOADING SYSTEM

This application is a continuation of provisional application 60/044,469, filed on Apr. 18, 1997, and now abandoned.

BACKGROUND OF THE INVENTION

This invention relates to a holder or holster for carrying an ammunition magazine for an automatic pistol and more particularly to a system for enabling one-handed loading of an ammunition magazine into an automatic pistol. The system can be quickly and easily configured for right-handed or left-handed users.

Various types of magazine holsters and holders are known, but none enables a user to load an ammunition magazine into an automatic pistol with only one hand. In situations where a police officer, for example, is shot or wounded in one arm, shoulder or hand so that only one hand and arm can be used to fire and reload an automatic pistol, the police officer is unable to reload his automatic pistol with a new ammunition magazine when using currently available ammunition holders. This can jeopardize the officer'ss life and perhaps the lives and safety of others.

It is, therefore, an object of the present invention to provide a system for enabling one-handed loading of an ammunition magazine into an automatic pistol.

Another object is to provide such a system which can be conveniently worn on the belt of a user.

A further object of the invention is the provision of such a system which includes interchangeable ammunition magazine holders for enabling the system to be used with automatic pistols of different calibers.

Still another object of the invention is to provide such a system which can be quickly and easily configured for righthanded or left-handed users.

Additional objects and advantages of the invention will be set forth in part in the description which follows, and in part will be obvious from the description, or may be learned by practice of the invention. The objects and advantages are realized and attained by means of the instrumentalities and combinations particularly pointed out in the appended claims.

SUMMARY OF THE INVENTION

To achieve these and other objects, the present invention provides a system for enabling one-handed loading of an ammunition magazine into an automatic pistol, the system comprising: a first support; first means in operative relationship with the support for attaching the support to a user; second means for removably receiving and holding an ammunition magazine for an automatic pistol; third means in operative relationship with the first support and with the second means for movably positioning the second means in a first position with respect to the first support for facilitating one-handed loading of the magazine into the automatic pistol by the user; and fourth means in operative relationship with the first support and with the second means for moving and holding the second means and the ammunition magazine held within the second means in a second position with respect to the first support for facilitating convenient carrying of the ammunition magazine by the user.

It is to be understood that both the foregoing general description and the following detailed description are exemplary and explanatory but are not restrictive of the invention.

BRIEF DESCRIPTION OF THE DRAWINGS

The accompanying drawings, which are incorporated in and constitute a part of this specification, illustrate a preferred embodiment of the invention and, together with the description, serve to explain the principles of the invention.

FIG. 6 is a fragmentary perspective view as in FIG. 5 and showing a gun in a position for sliding the gun over a magazine held by the system; and FIG. 7 is a perspective view of a second U-shaped member embodiment for receiving and holding ammunition magazines for Colt ten millimeter or forty-five caliber automatic pistols.

DESCRIPTION OF THE PREFERRED EMBODIMENT

Figure 1:
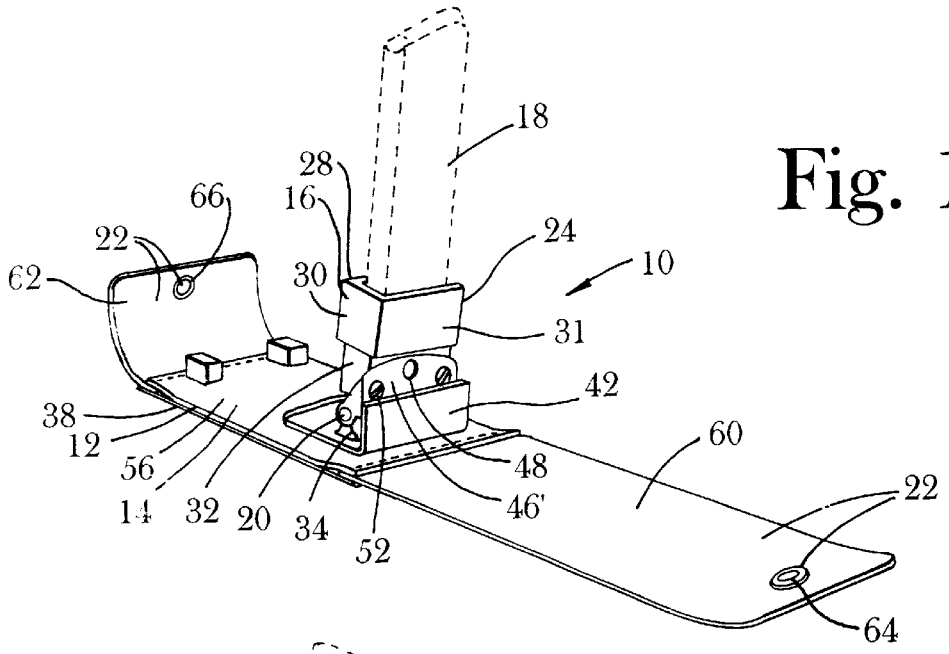
FIG. 1 is a perspective view showing the system in an open position and having a U-shaped member attached thereto for receiving and holding ammunition magazines for Colt ten millimeter or forty-five caliber automatic pistols.

With reference now to the drawings, wherein like reference characters designate like or corresponding parts throughout the several views, there is shown a system 10 for enabling one-handed loading of an ammunition magazine into an automatic pistol 11. System 10 includes a first support 12 and first means 14 in operative relationship with support 12 for attaching support 12 to a user.

System 10 further includes second means 16 for removably receiving and holding an ammunition magazine 18 for an automatic pistol. Third means 20 also are provided in operative relationship with first support 12 and with second means 16 for movably positioning second means 16 in a first position (shown in FIGS. 1, 3, 5 and 6) with respect to first support 12 for facilitating one-handed loading of magazine 18 into the automatic pistol by the user.

System 10 further includes fourth means 22 in operative relationship with first support 12 and with second means 16 for moving and holding second means 16 and ammunition magazine 18, held within second means 16, in a second position (shown in FIG. 4) with respect to first support 12 for facilitating convenient carrying of ammunition magazine 18 by the user.

In accordance with the invention, second means 16 include a U-shaped member 24 defining a base 26, first and second opposed sides 28, 28' extending upwardly from base 26 and an end wall 30 extending between sides 28, 28'. Base 26 defines dimensions for enabling magazine 18 to be removably positioned and held within U-shaped member 24 between sides 28, 31, and second means 16 further include a second support 32 extending downwardly from base 26. Second support 32 is connected to third means 20, and second support 32 is preferably removably connected to third means 20.

Third means 20 preferably include a spring-loaded hinge 34 biased by spring 36 toward an open position, as shown in FIGS. 1, 3, 5 and 6.

First support 12 defines a flat portion 38 connected to hinge 34 by screws or by other conventional fastening elements 40. First support 12 further defines a stop element 42 oriented at a right angle with respect to flat portion 38 and positioned to engage a portion of hinge 34 to limit movement of hinge 34 toward an open position.

Figure 4:
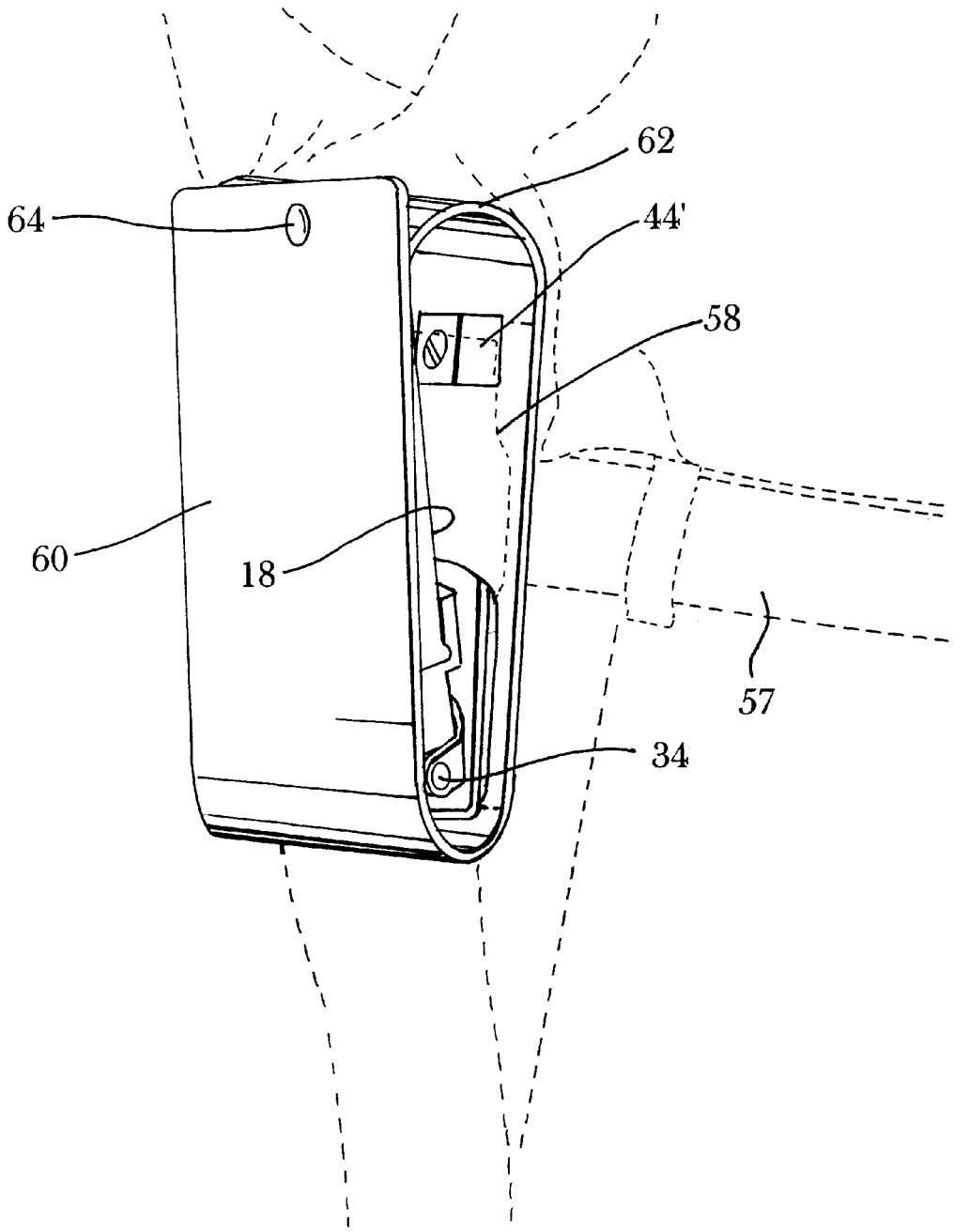
FIG. 4 is a fragmentary perspective view showing the system mounted on a user's belt and in a closed position.
Figure 5:
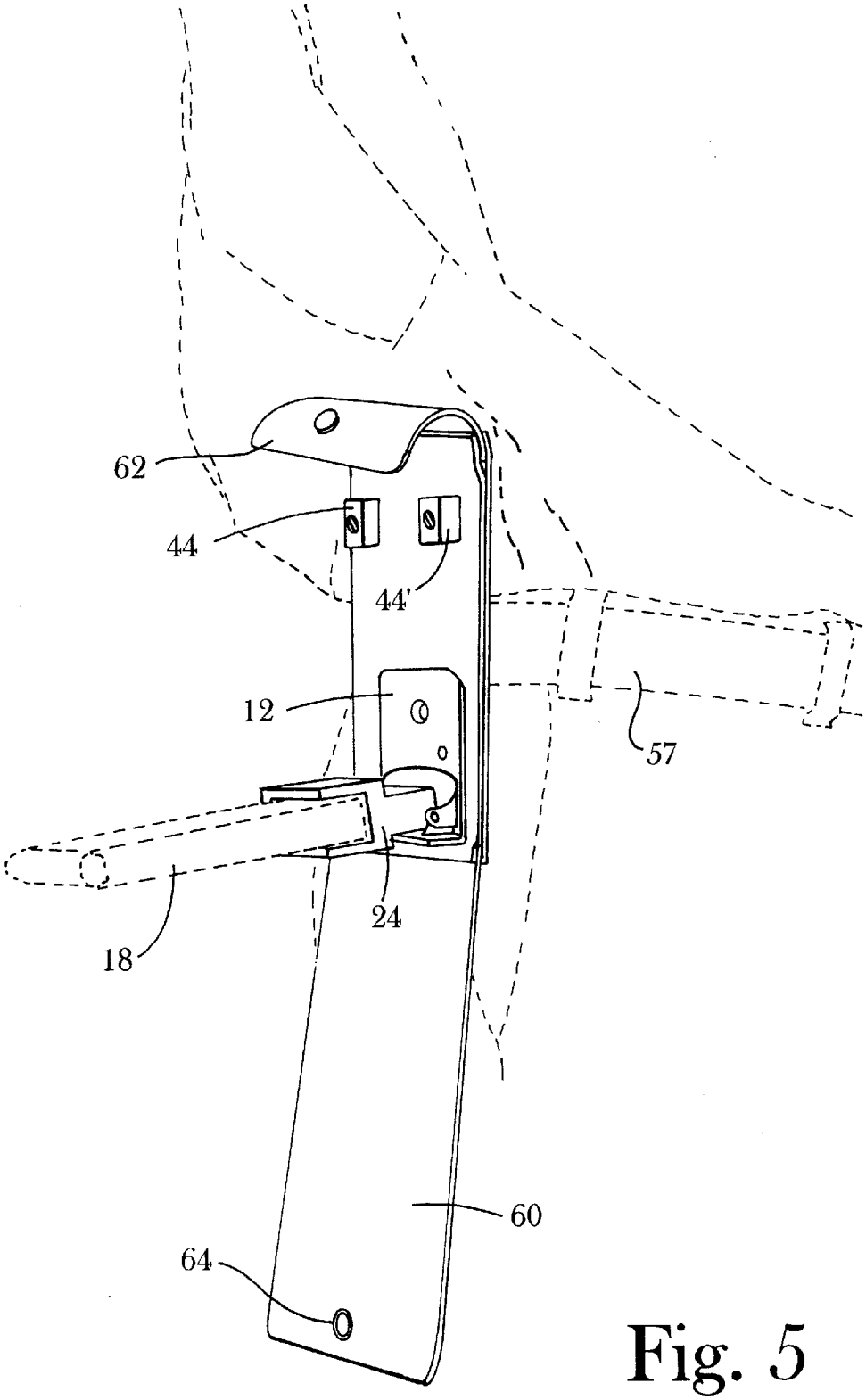
FIG. 5 is a fragmentary perspective view showing the system mounted on a user's belt and in an open position.

System 10 further includes first and second spaced-apart guide elements 44, 44' conventionally connected to flat portion 38 of support 12, such as by screws or other conventional fastening elements, for receiving ammunition magazine 18 between guide elements 44, 44' when second means 16 and ammunition magazine 18, held within second means 16, are in the second or closed position with respect to first support 12 as shown in FIG. 4.

Hinge 34 defines first and second hinge sides 46, 46'. First hinge side 46 is connected to flat portion 38 of support 12, and second hinge side 46' is connected to second means 16. More specifically, second hinge side 46' is connected to second support 32 of second means 16.

In accordance with the invention, second hinge side 46' is removably connected to second support 32, and second hinge side 46' preferably defines at least a first screw-receiving opening 48 therein. Second support 32 defines at least a second screwreceiving opening 50 therein. At least a first screw 52 is removably positioned through openings 48, 50 for removably fastening second support 32 and second means 16 to second hinge side 46'.

Figure 2:
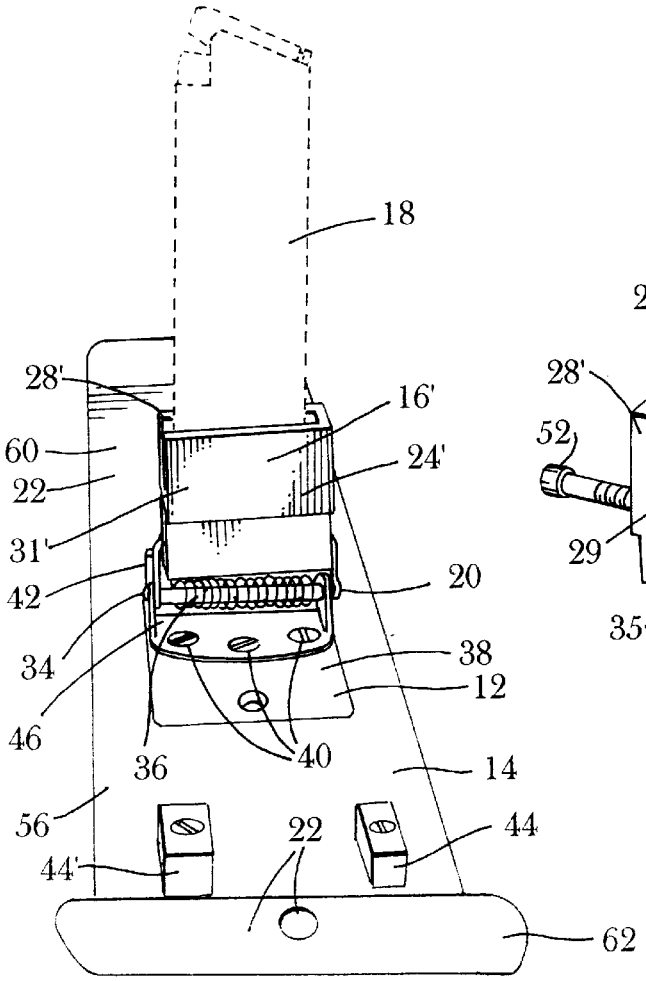
FIG. 2 is a perspective view of a U-shaped member embodiment for receiving and holding ammunition magazines for Glock or Beretta nine millimeter automatic pistols.
Figure 3:
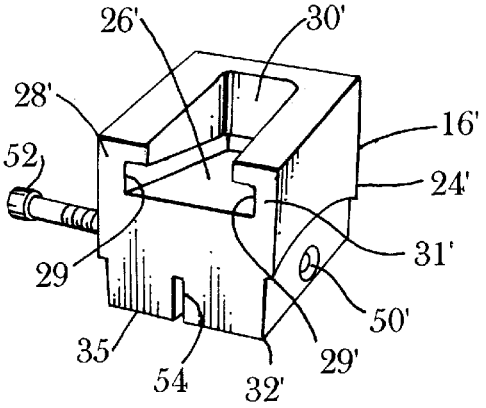
FIG. 3 is another perspective view showing the system in an open position and having the U-shaped member shown in FIG. 2 attached thereto.

A plurality of second means 16 and 16' of different sizes and configurations are provided for interchangeable use with system 10 to accommodate ammunition magazines 18 of different sizes and configurations for different pistols. A detailed illustration of second means 16 for removably receiving and holding an ammunition magazine 18 for Colt ten millimeter or forty-five caliber automatic pistols, for example, is illustrated in FIG. 7. A detailed illustration of second means 16' for removably receiving and holding an ammunition magazine for Beretta nine millimeter and Glock nine millimeter automatic pistols is shown in FIG. 2. Second means 16' will be slightly larger for receiving the Glock magazine. Second means 16' provides for second support 32' defining a slot 54 of predetermined dimensions therein for removably receiving second hinge side 46' within slot 54.

In U-shaped member 24' configured for use with ammunition magazines for Glock and Beretta automatic pistols, opposed sides 28', 31' each defines a groove 29, 29', respectively, therein for slideably receiving conventional flange portions (not shown) of the conventional Glock or Beretta ammunition magazines therein.

Second means 16, 16' can be mounted onto hinge side 46' in either one of two positions to accommodate right-handed or left-handed users. For example, second means 16, 16' can be mounted on hinge side 46' as shown in the figures or second means 16, 16' can be mounted on hinge side 46' in a position reversed from that shown in the figures. This enables system 10 to be carried on the left or right side of a user.

Further in accordance with the invention, first means 14 preferably include a flexible cover 56 fitted over support 12 and a flexible loop 58 attached to cover 56 in a conventional manner, such as by sewing, for receiving a user's belt 57 through loop 58 so that system 10 can be worn on a belt of the user.

Fourth means 22 include first and second flexible flaps 60, 62 connected to flexible cover 56. Fourth means 22 further include first and second fastening elements 64, 66 connected respectively to flaps 60, 62 for removably fastening flaps 60, 62 together. Fastening elements 64, 66 can be conventional snaps or hook and loop material, such as Velcro.

Second means 16, 16' for removably receiving and holding an ammunition magazine 18 are preferably comprised of plastic material, such as nylon or Delron. Cover 56, loop 58 and flaps 60, 62 are preferably comprised of leather, plastic or fabric. Support 12 is preferably comprised of metal or plastic.

In operation and use, U-shaped member 24 or 24' is attached to side 46' of hinge 34 by screw or screws 52. If U-shaped member 24 is used, second support 32 is positioned alongside second side 46' of the hinge, and screws 52 are passed through openings 50 in U-shaped member 24 and into openings 48 within second support 32. See FIG. 1.

If U-shaped member 24' is used, slot 54 is slideably positioned over side 46' of hinge 34, and screw or screws 52 are then threadably passed through openings 48, 50 to retain U-shaped member 24' on hinge side 46'. See FIG. 3.

Loop 58 is then positioned over belt 57 of a user so that system 10 can be conveniently transported by the user for use when necessary.

A conventional ammunition magazine 18 is slideably positioned within U-shaped member 24 or 24' so that the bottom of the magazine is positioned on base 26 or 26' of the U-shaped member. If Colt automatic pistol ammunition magazines are used, U-shaped member 24 has smooth interior side surfaces on sides 28, 31. If Glock or Beretta ammunition magazines are to be carried, the conventional flange portions of those ammunition magazines are slideably inserted into grooves 29, 29' of U-shaped member 24', and the bottom of the Glock or Beretta magazine rests on base 26'.

The insertion of magazine 18 into U-shaped member 24 or 24' is done with system 10 positioned as shown in FIGS. 1, 3, 5 and 6. The user can then grasp flap 60 and can move flap 60 toward support 12 to cause movement of hinge 34 and of ammunition magazine 18 to the closed position illustrated in FIG. 4. Flap 60 is then connected to flap 62 by fastening elements 64, 66, and system 10 will then be configured for transport on the belt of a user.

If it becomes necessary for the user to reload his automatic pistol with the use of only one hand, the empty pistol magazine is first ejected from the pistol in a conventional manner and the user then unfastens fastening elements 64, 66 from each other. This can be quickly and easily done with only one hand. The spring action of hinge 34 then causes rotation of the hinge and of ammunition magazine 18 contained within U-shaped member 24, or 24' to the position shown in FIGS. 1, 3, 5 and 6. The user can then, with one hand, move automatic pistol 11 down over ammunition magazine 18 so that the ammunition magazine enters the pistol until the butt of the pistol contacts U-shaped member 24 or 24'.

The user, with one hand, then moves pistol 11 with magazine 18 partially inserted therein in a direction to slideably withdraw magazine 18 from U-shaped member 24 or 24'. After magazine 18 has been completely withdrawn from U-shaped member 24 or 24', the magazine can be driven home into the pistol by striking the bottom of magazine 18 against support 12 or against any other conveniently located hard surface. The automatic pistol is then completely reloaded with a full magazine 18.

When system 10 is positioned in the "closed" configuration shown in FIG. 4, ammunition magazine 18 is positioned between guide elements 44, 44' to prevent movement of magazine 18.

The configuration of U-shaped member 24' having slot 54 therein is only required where the width of U-shaped member 24' is too great to permit full closure of system 10 to the position shown in FIG. 4. The use of slot 54 which slides down and over the end edge of second side 46' of hinge 34 enables full closure of system 10 to the position shown in FIG. 4. The depth of slot 54 and the dimensions of U-shaped member 24' are preferably such that bottom surface 35 of member 24' is located with respect to side 46' of the hinge so that second support 32 of member 24' does not interfere with or engage stop element 42 when system 10 is positioned in a so-called "open" position shown in FIGS. 1, 3, 5 and 6.

This invention provides for a ruggedly constructed and conveniently usable holder for carrying an ammunition magazine for an automatic pistol and for enabling one-handed loading of an ammunition magazine into an automatic pistol by right or left-handed users.

The invention in its broader aspects is not limited to the specific details shown and described, and departures may be made from such details without departing from the principles of the invention and without sacrificing its chief advantages.

What is claimed is:

1. A system for enabling one-handed loading of an ammunition magazine into an automatic pistol, said system comprising:

a first support;

first means in operative relationship with said support for attaching said support to a user;

second means for removably receiving and holding an ammunition magazine for an automatic pistol;

third spring-loaded hinge means in operative relationship with said first support and with said second means for movably positioning said second means in a first position with respect to said first support for facilitating one-handed loading of said magazine into said automatic pistol by said user; and fourth means in operative relationship with said first support and with said second means for moving and holding said second means and said ammunition magazine held within said second means in a second position with respect to said first support for facilitating convenient carrying of said ammunition magazine by the user.

2. A system as in claim 1 wherein said second means include:

a substantially U-shaped member defining a base, first and second opposed sides extending upwardly from said base and an end wall extending between said first and second sides;

said base defining dimensions for enabling said magazine to be removably positioned and held within said U-shaped member between said first and second sides; and a second support extending downwardly from said base, said second support connected to said third means.

3. A system as in claim 2 wherein said second support is removably and reversably connected to said third means.

4. A system as in claim 3 wherein said third means include a spring-loaded hinge biased by said spring toward an open position.

5. A system as in claim 4 wherein said first support defines a substantially flat portion connected to said hinge and wherein said first support further defines a stop element oriented at substantially a right angle with respect to said flat portion and positioned to engage a portion of said hinge to limit movement of said hinge.

6. A system as in claim 5 further including first and second spaced-apart guide elements connected to said first support for receiving said ammunition magazine therebetween when said second means and said ammunition magazine held within said second means are in said second position with respect to said first support.

7. A system as in claim 6 wherein said hinge defines first and second hinge sides, said first hinge side connected to said first support and said second hinge side connected to said second means.

8. A system as in claim 7 wherein said second hinge side is connected to said second support of said second means.

9. A system as in claim 8 wherein said second hinge side is removably connected to said second support of said second means.

10. A system as in claim 9 wherein said second hinge side defines at least a first screw-receiving opening therein and wherein said second support defines at least a second screw-receiving opening therein, and further including at least a first screw removably positioned through said first and second openings for removably fastening said second support to said second hinge side.

11. A system as in claim 10 wherein said second support defines a slot of predetermined dimensions therein for removably receiving said second hinge side within said slot.

12. A system as in claim 11 wherein said first and second opposed sides of said U-shaped member each defines a groove therein for slideably receiving predetermined portions of said ammunition magazine therein.

13. A system as in claim 2 wherein said first and second opposed sides of said U-shaped member each defines a groove therein for slideably receiving predetermined portions of said ammunition magazine therein.

14. A system as in claim 12 further including a plurality of said second means of different sizes for interchangeable use to accommodate ammunition magazines of different sizes for different pistols.

15. A system as in claim 14 wherein said second means are comprised of plastic material.

16. A system as in claim 1 wherein said first means include a cover fitted over said first support and a flexible loop attached to said cover for receiving a user's belt through said loop whereby said system can be worn on a belt of the user.

17. A system as in claim 16 wherein said fourth means include first and second flexible flaps connected to said cover, and first and second fastening elements connected to said first and second flaps, respectively, for removably fastening said first and second flaps together.

18. A system as in claim 17 wherein said cover, said loop and said flaps are comprised of leather, plastic or fabric.

19. A system as in claim 18 wherein said first support is comprised of metal or plastic.

* * * * *